US012612710B2

(12) United States Patent
Seki et al.

(10) Patent No.: US 12,612,710 B2
(45) Date of Patent: Apr. 28, 2026

(54) SUBSTRATE HOLDER, SUBSTRATE PLATING DEVICE EQUIPPED THEREWITH, AND ELECTRICAL CONTACT

(71) Applicant: EBARA CORPORATION, Tokyo (JP)

(72) Inventors: Masaya Seki, Tokyo (JP); Kiyoshi Suzuki, Tokyo (JP); Masayuki Satake, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 1086 days.

(21) Appl. No.: 17/641,767

(22) PCT Filed: Jul. 7, 2020

(86) PCT No.: PCT/JP2020/026552
§ 371 (c)(1),
(2) Date: Mar. 9, 2022

(87) PCT Pub. No.: WO2021/049145
PCT Pub. Date: Mar. 18, 2021

(65) Prior Publication Data

US 2022/0372647 A1 Nov. 24, 2022

(30) Foreign Application Priority Data

Sep. 10, 2019 (JP) ..... 2019-164407

(51) Int. Cl.
*C25D 17/00* (2006.01)
*C25D 17/06* (2006.01)

(52) U.S. Cl.
CPC ..... *C25D 17/005* (2013.01); *C25D 17/00* (2013.01); *C25D 17/001* (2013.01); *C25D 17/06* (2013.01)

(58) Field of Classification Search
CPC .... C25D 17/005; C25D 17/06; C25D 17/004; C25D 17/001; C25D 17/08; C25D 17/00
See application file for complete search history.

(56) References Cited

U.S. PATENT DOCUMENTS 6,139,712 A 10/2000 Patton et al.
10,316,425 B2 6/2019 Yajima et al.
(Continued)

FOREIGN PATENT DOCUMENTS

JP 2004076022 A * 3/2004
JP 2005-220414 A 8/2005
(Continued)

OTHER PUBLICATIONS

International Patent Application No. PCT/JP2020/026552; Int'l Search Report; dated Sep. 29, 2020; 3 pages.

*Primary Examiner* — James Lin
*Assistant Examiner* — Kevin Sylvester
(74) *Attorney, Agent, or Firm* — BakerHostetler

(57) ABSTRACT

Provided is a substrate holder for plating on a surface of a substrate, provided with an electrical contact that is easy to replace. A substrate holder 1 includes: a first holding member 2; a second holding member 3 that has an opening portion 3*a* for exposing the surface of a substrate W and holds the substrate W in a sandwiched manner with the first holding member 2; a plurality of engaging shaft portions 36 each having a head portion 36*b* in an expanded head shape at a tip end portion, provided in a circumferential direction of the second holding member 3; and an electrical contact 32 having a contact portion 32*a* to be in contact with an edge portion of the substrate W, and having an engagement reception portion 32*b* in a notch shape to be engaged with the adjacent engaging shaft portion 36 for arrangement along a circumference of the opening portion 3*a* of the second holding member 3.

10 Claims, 11 Drawing Sheets

(56) References Cited

U.S. PATENT DOCUMENTS

| | | | | |
|---|---|---|---|---|
| 10,738,390 | B2 | 8/2020 | Miyamoto | |
| 2005/0014368 | A1 | 1/2005 | Yoshioka et al. | |
| 2005/0274604 | A1 | 12/2005 | Satio et al. | |
| 2013/0062197 | A1* | 3/2013 | He | C25D 17/001 204/297.05 |
| 2015/0247253 | A1* | 9/2015 | Yajima | C25D 17/06 205/136 |
| 2017/0321343 | A1* | 11/2017 | Miyamoto | C25D 7/123 |
| 2018/0155847 | A1* | 6/2018 | Miyamoto | C25D 17/004 |
| 2019/0219627 | A1 | 7/2019 | Tomita et al. | |
| 2020/0199770 | A1* | 6/2020 | Moriyama | C25D 21/00 |
| 2022/0372647 | A1* | 11/2022 | Seki | C25D 17/06 |

FOREIGN PATENT DOCUMENTS

| | | | | |
|---|---|---|---|---|
| JP | 2009-123918 | A | 6/2009 | |
| JP | 2015-165040 | A | 9/2015 | |
| JP | 2017-203178 | A | 11/2017 | |
| JP | 2018-040045 | A | 3/2018 | |
| JP | 2018-119875 | A | 8/2018 | |
| JP | 2019007075 | A * | 1/2019 | C25D 21/00 |
| WO | WO 2019/021607 | A1 | 1/2019 | |

* cited by examiner

[FIG.1]
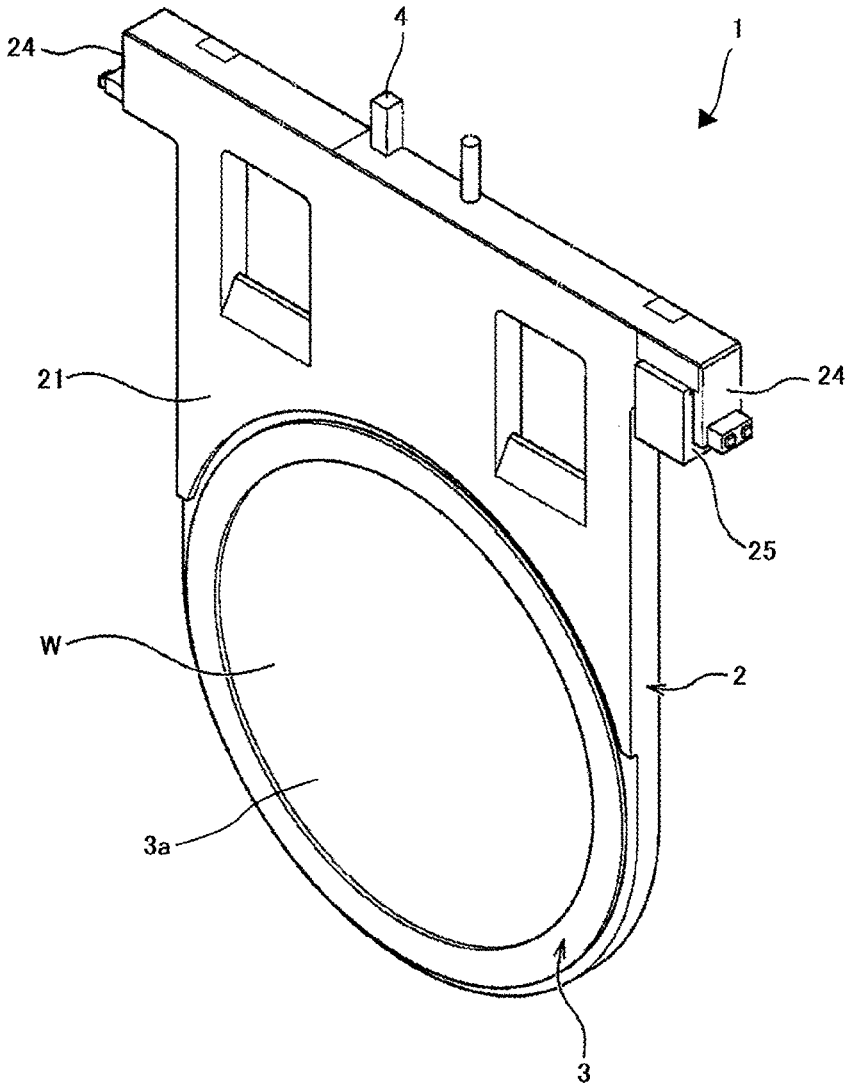

[FIG.2]
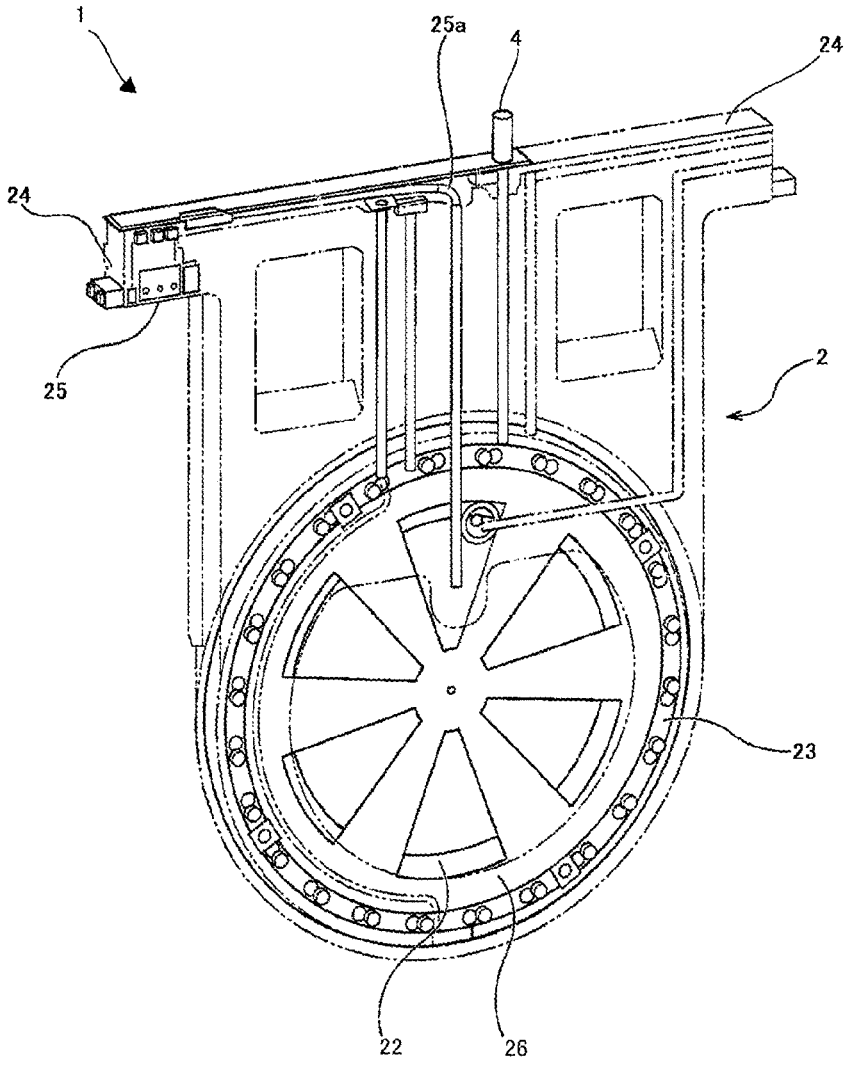

[FIG.3]
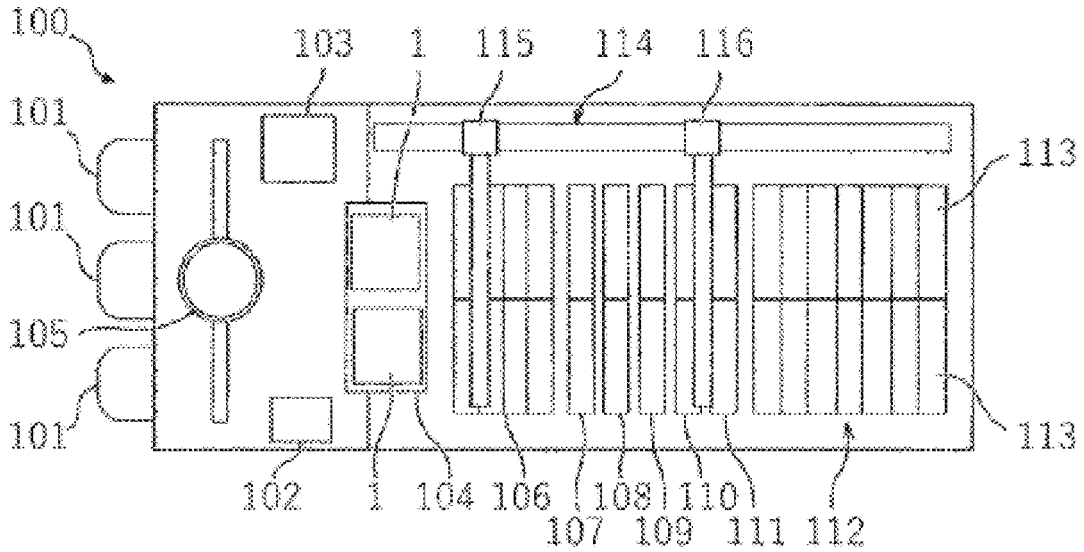
[FIG.4]
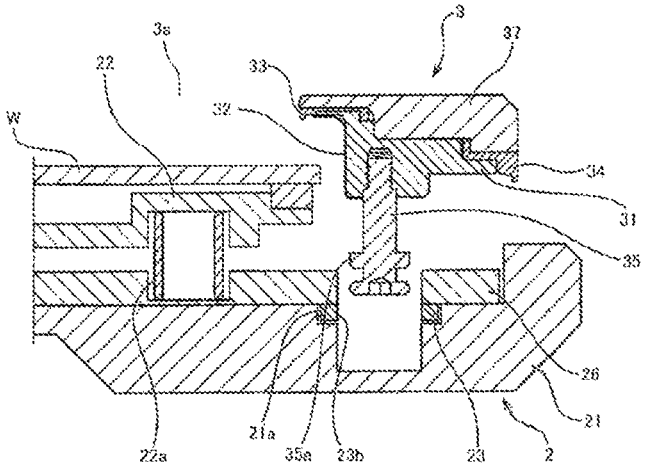

[FIG.5]
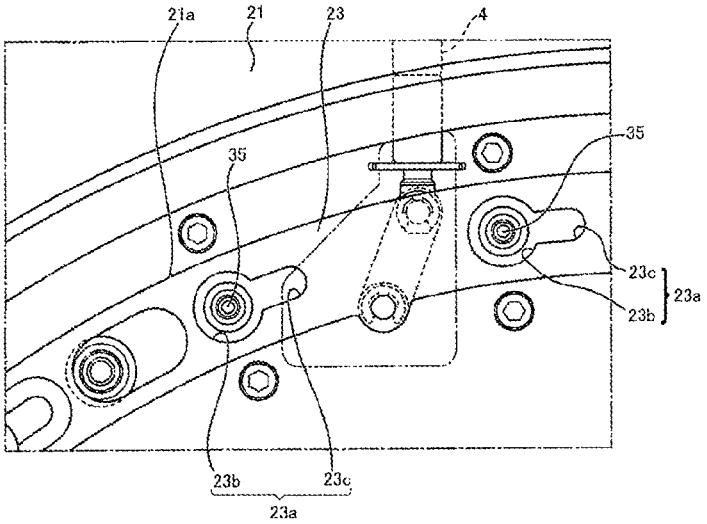
[FIG.6]
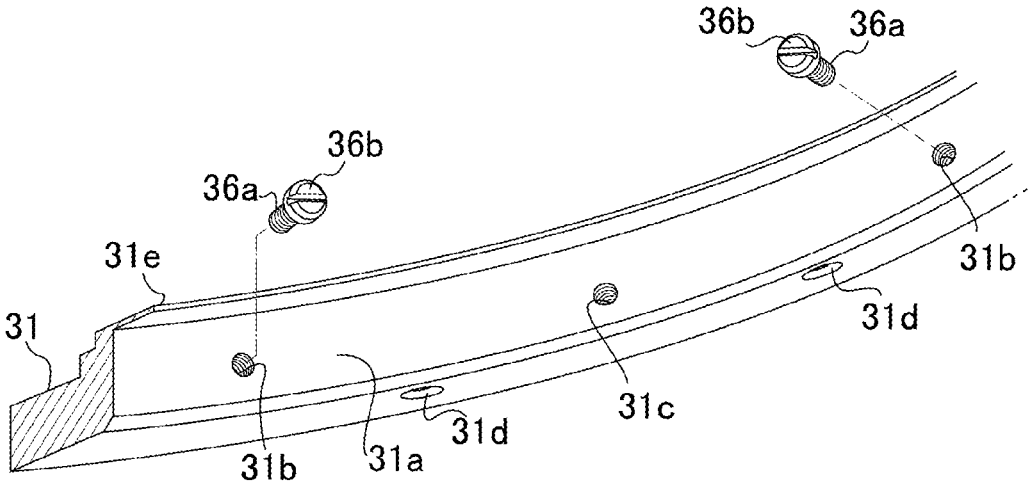

[FIG.7]
(A)
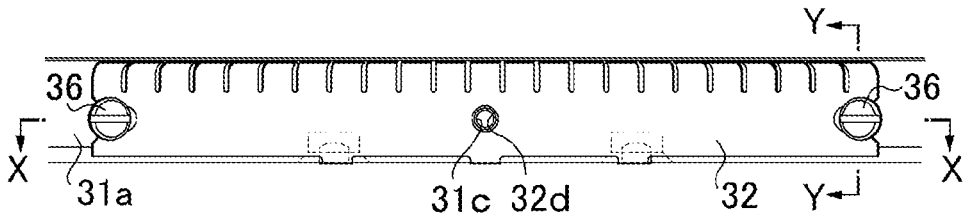
(B)
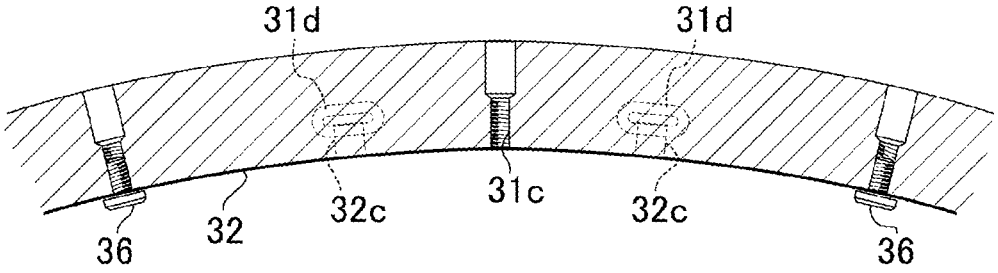
(C)
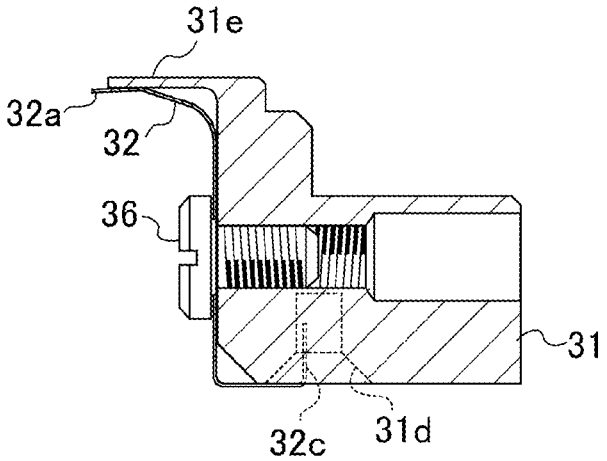

[FIG.8]
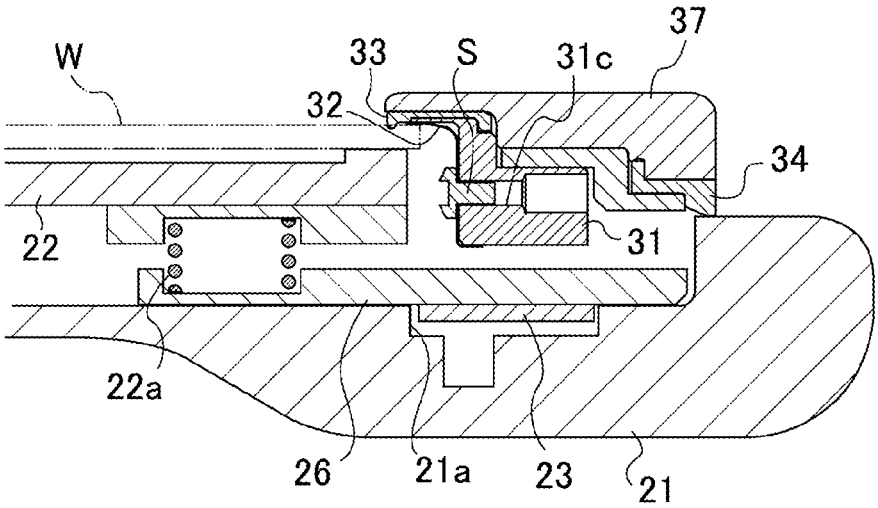

[FIG.9]
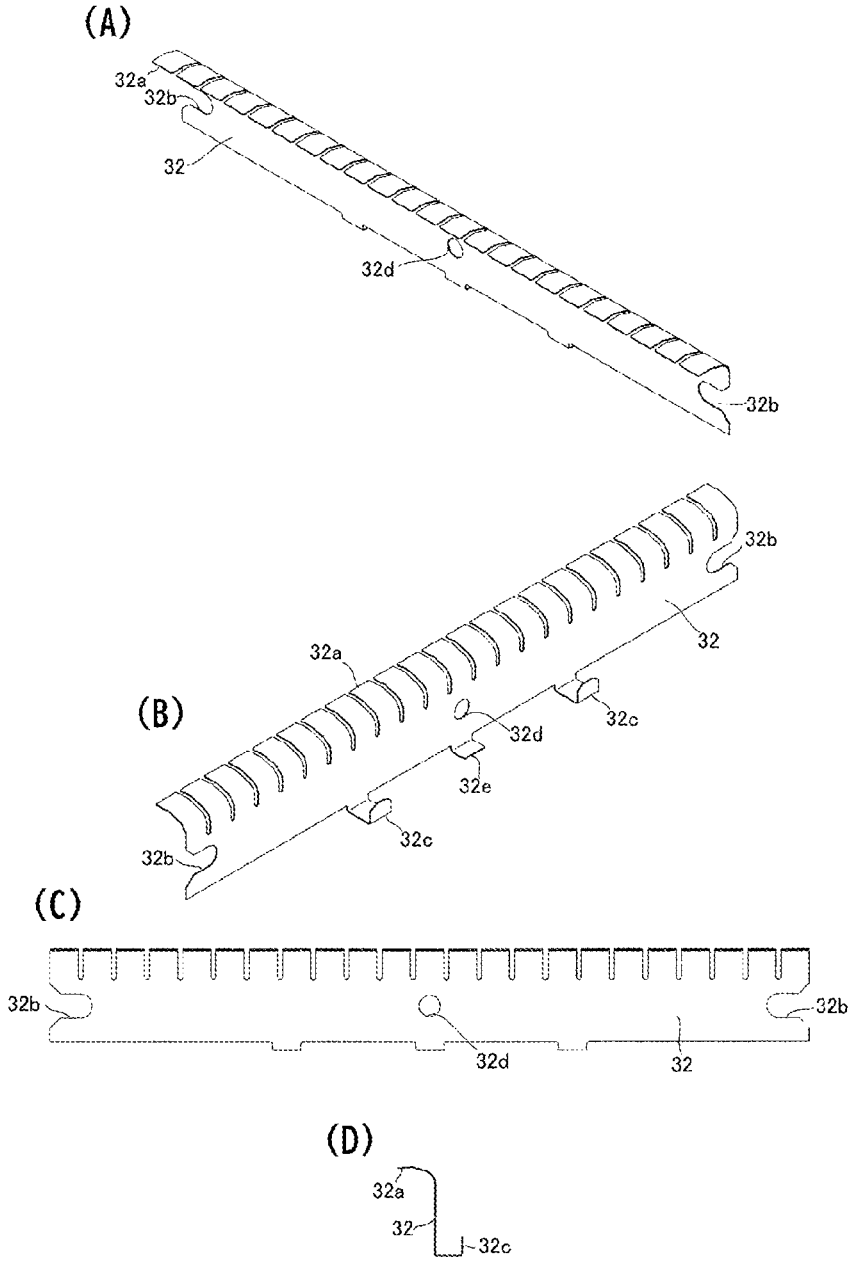

[FIG.10]
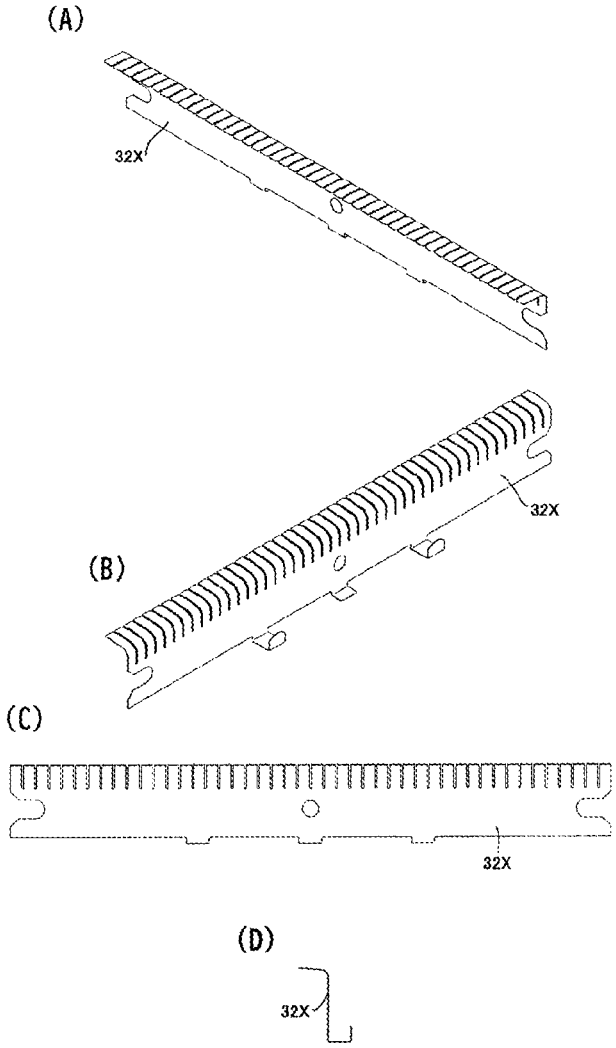

[FIG.11]
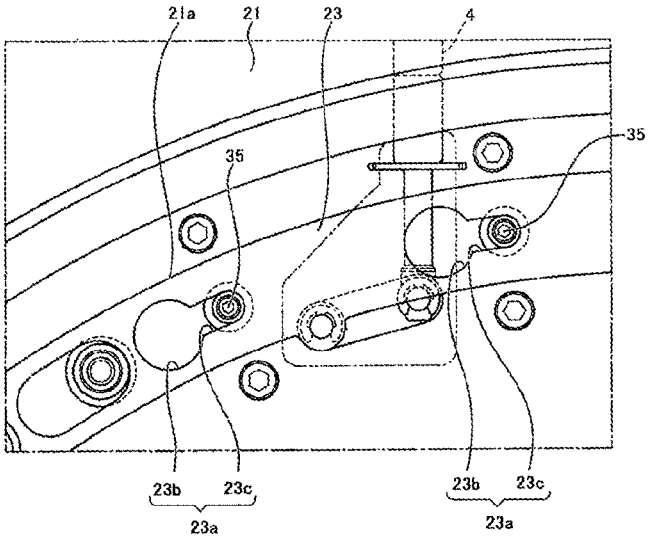
[FIG.12]
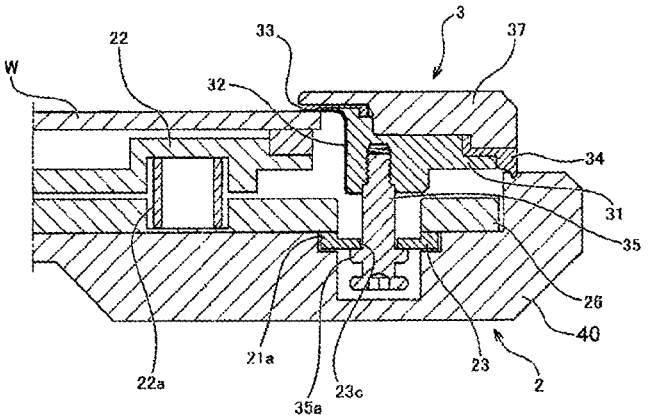

[FIG.13]
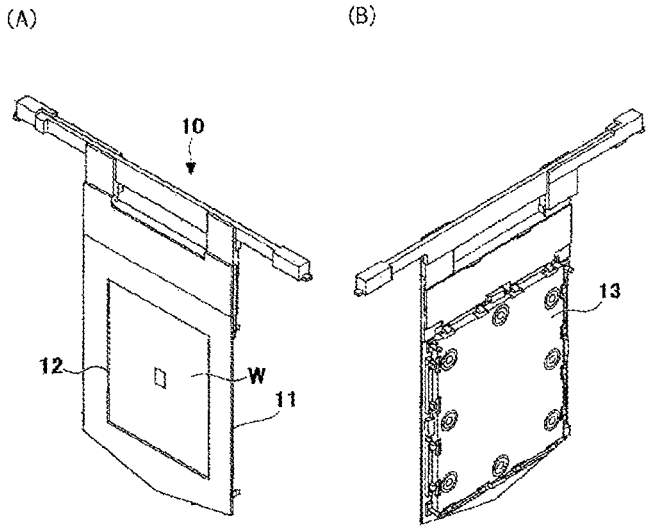
[FIG.14]
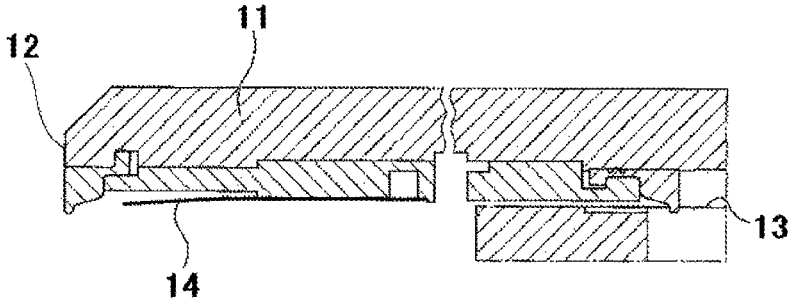

[FIG.15]
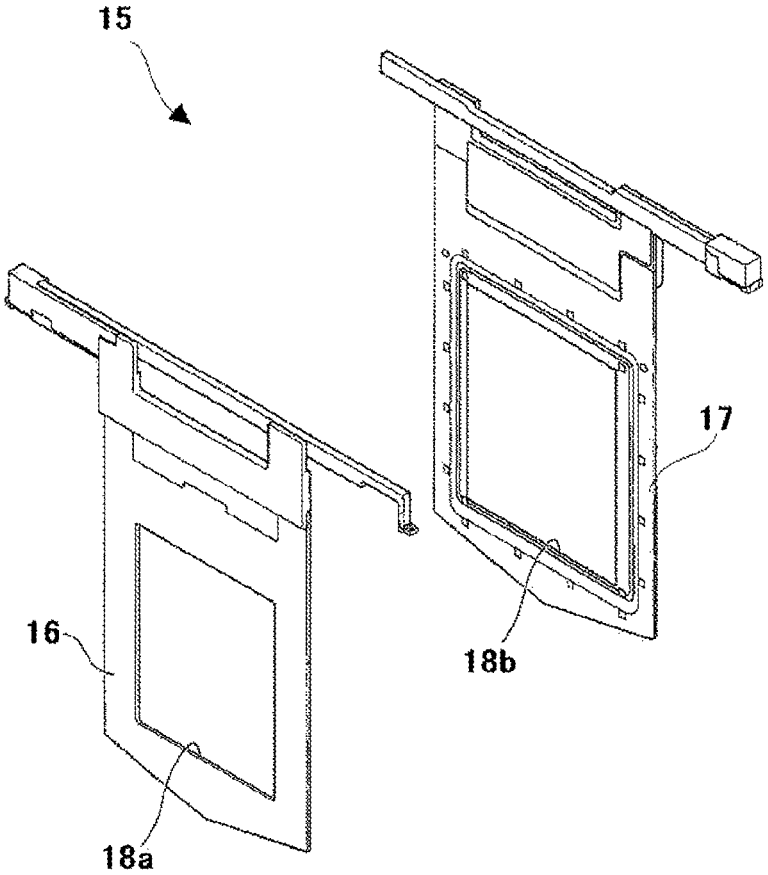
[FIG.16]
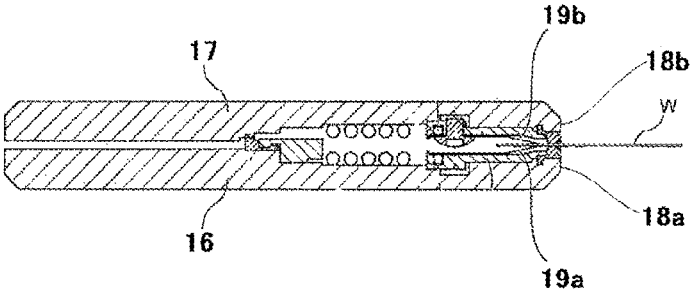

SUBSTRATE HOLDER, SUBSTRATE PLATING DEVICE EQUIPPED THEREWITH, AND ELECTRICAL CONTACT

TECHNICAL FIELD

The present invention relates to a substrate holder that holds a substrate such as a semiconductor wafer in a substrate plating device, a substrate plating device provided with the substrate holder, and an electrical contact.

BACKGROUND ART

On the surfaces of substrates such as a semiconductor wafer, a printed circuit board and the like, wiring and bumps (protruding electrodes) are to be formed. In order to form wiring and bumps (protruding electrodes) on a substrate, for example, an electrolytic plating method, a vapor deposition method, a printing method, a ball-bump method and the like are employed. Among these, the electrolytic plating method that enables microfabrication and stabilization of performance is widely employed.

The electrolytic plating method immerses a substrate in a plating solution and applies an electric current to form a plate on a surface of the substrate. A substrate plating device employing the electrolytic plating method is exemplified by a device enabling plating on a surface of a substrate through immersing in a plating solution a substrate holder holding the substrate with only the surface of the substrate (face to be plated) being exposed and applying an electric current to the substrate.

With regard to such a substrate plating device and a substrate holder, Patent Literature 1 identified below discloses a substrate holder including: a first holding member having a supporting face that supports a substrate; and a second holding member that holds the substrate in a sandwiched manner with the first holding member, in which the first holding member has a plate-like first contact arranged along a circumference of a supporting face, and the second holding member has a second contact including a first end portion in contact with the substrate arranged on the supporting face and a second end portion in contact with the first contact, the second end portion being configured to be in plastic contact with the first contact when the substrate is held by the first holding member and the second holding member. This substrate holder ensures the second contact to be in contact with the first contact without requiring the first contact and the second contact to be formed with an expensive spring material.

Although the substrate holder exemplified in the above-cited Patent Literature 1 is capable of holding a round substrate, in recent years an increase in size of substrates is accompanied by emergence of rectangular substrates and the like, leading to development of a substrate holder capable of holding a rectangular substrate (see Patent Literature 2 identified below). Furthermore, a substrate holder permitting plating on both faces of a substrate has also been developed (see Patent Literature 3 identified below).

CITATION LIST

Patent Literature

Patent Literature 1: Japanese Patent Laid-Open No. 2017-203178

Patent Literature 2: Japanese Patent Laid-Open No. 2018-40045

Patent Literature 3: Japanese Patent Laid-Open No. 2019-7075

SUMMARY OF INVENTION

Technical Problem

A substrate holder, for example as shown in Patent Literature 1, holds a substrate in a sandwiched manner between two holding members, and allows plating on the substrate through application of an electric current in a state in which a second contact provided in one holding member is in contact with the substrate and also in contact with a first contact in the other holding member upon holding.

Such electrical contacts may cause contact failure due to a stain or the like in a region to be in contact with the substrate. In addition, a space formed by the two holding members is hermetically sealed during plating and such a structure inhibits a plating solution from being applied to an electrical contact within the space, yet the plating solution may be splashed and adhere to the contact upon opening of the holding members, leading to a current-carrying failure.

In this regard, the electrical contact is replaced on a regular basis, or when a failure occurs. The electrical contact, for example as shown in FIG. 7 of Patent Literature 1, is provided with a plurality of holes (five holes in FIG. 7) into which screws are fastened for fixation onto a holding member. However, screw-fastening at five sites per electrical contact has been required, and thus a replacement operation has been time-consuming.

Furthermore, as disclosed in Patent Literature 1, when the substrate is round, the holding members are also round, and a contact is to be fixed onto an inner peripheral face thereof. Having to fix the plate-like contact along an arc-like concave face has made the operation more difficult.

Given the foregoing, a principal objective of the present invention is to provide a substrate holder for plating on a surface of a substrate, provided with an electrical contact that is easy to replace.

Solution to Problem

A substrate holder for plating on a surface of a substrate according to one mode of the present invention includes: a first holding member; a second holding member that has an opening portion for exposing the surface of the substrate and holds the substrate in a sandwiched manner with the first holding member; a plurality of engaging shaft portions each having a head portion in an expanded head shape at a tip end portion, provided in a circumferential direction of the second holding member; and an electrical contact having a contact portion to be in contact with an edge portion of the substrate, and having an engagement reception portion in a notch shape to be engaged with the adjacent engaging shaft portion for arrangement along a circumference of the opening portion of the second holding member.

By thus providing the plurality of engaging shaft portions each having the head portion in an expanded head shape at the tip end portion at predetermined intervals on the second holding member of the substrate holder, and attaching the electrical contact by engaging the engagement reception portion in a notch shape provided on the electrical contact with the engaging shaft portion, easy attachment of the electrical contact to the second holding member is enabled and a replacement operation is facilitated.

In the substrate holder according to the one mode, it is preferred that the engagement reception portion is configured as a notch in a curved concave shape. Such a configuration facilitates the engagement reception portion to be engaged with the engaging shaft portion, and in turn facilitates the replacement operation.

In the substrate holder according to the one mode, it is preferred that the electrical contact is provided with a hook piece portion in a hook shape to be engaged with an engagement groove provided in the second holding member. In addition to the engagement reception portion, the hook piece portion can also engage with the second holding member, enabling an increase in an engagement force.

In the substrate holder according to the one mode, it is preferred that: a hole portion is provided in the vicinity of the center of the electrical contact; and the electrical contact is fixed to the second holding member by inserting a fastening member into the hole portion and fastening the fastening member. Such a configuration enables the electrical contact to be reliably fixed to the second holding member with at least one fastening member such as a screw, enabling a convenient replacement operation compared to the conventional art.

In the substrate holder according to the one mode, it is preferred that the second holding member is formed of an electrically conductive metal. Such a configuration makes the second holding member electrically conductive, whereby an electric current applied to the second holding member can also be applied to the electrical contact, thus inhibiting a current-carrying failure and the like.

The substrate holder according to the one mode includes, on a side of the opening portion of the second holding member, an inner peripheral face curved in an inner-outer direction of the second holding member, and the electrical contact can be attached along the inner peripheral face. In such a configuration, the electrical contact is attached in a deflected state, enabling stable attachment along the inner peripheral face under the action of an elastic force.

In the substrate holder according to the one mode, the second holding member may be configured in a polygonal frame shape or a round frame shape. It can accept, in addition to a round substrate, a polygonal substrate such as a rectangular substrate, and the electrical contact can be attached to a substrate holder of any configuration.

The present invention is directed also to a substrate plating device provided with the substrate holder according to the one mode, a contact for the substrate holder, and an electrical contact attachment structure for the substrate holder.

BRIEF DESCRIPTION OF DRAWINGS

FIG. 1 is a front side perspective view showing a substrate holder according to a first embodiment of the present invention oriented vertically in a state of holding a substrate.

FIG. 2 is a rear side perspective view showing the substrate holder of FIG. 1 with a body portion being transparent.

FIG. 3 is a schematic plan view showing an example of a substrate plating device employing the substrate holder of FIG. 1.

FIG. 4 is a partial enlarged cross-sectional view showing the substrate holder of FIG. 1 in a state in which the substrate is placed on a substrate mount table.

FIG. 5 is a partial enlarged plan view of the state of FIG. 4.

FIG. 6 is a partial enlarged view showing a part of a main body portion constituting the second holding member in the substrate holder of FIG. 1.

FIG. 7 shows a state in which an electrical contact is attached to the main body portion constituting the second holding member in the substrate holder of FIG. 1, (A) being a partial enlarged view, (B) being a cross-sectional view taken along a line X-X, and (C) being a cross-sectional view taken along a line Y-Y.

FIG. 8 is a partial enlarged cross-sectional view of the vicinity of a fastening member of the electrical contact in the substrate holder of FIG. 1 in a state of holding the substrate.

FIG. 9 shows an example of the electrical contact used in the substrate holder of FIG. 1, (A) being a front side perspective view, (B) being a rear side perspective view, (C) being a front view, and (D) being a lateral view.

FIG. 10 shows another example of the electrical contact used in the substrate holder of FIG. 1, (A) being a front side perspective view, (B) being a rear side perspective view, (C) being a front view, and (D) being a lateral view.

FIG. 11 is a partial enlarged plan view showing the substrate holder of FIG. 1 in a state of holding the substrate.

FIG. 12 is a partial enlarged cross-sectional view of the state of FIG. 11.

FIG. 13 is an exploded perspective view showing a substrate holder according to a second embodiment of the present invention.

FIG. 14 is a partial enlarged cross-sectional view showing the substrate holder of FIG. 13 in a state of holding the substrate.

FIG. 15 is an exploded perspective view showing a substrate holder according to a third embodiment of the present invention.

FIG. 16 is a partial enlarged cross-sectional view showing the substrate holder of FIG. 15 in a state of holding the substrate.

DESCRIPTION OF EMBODIMENTS

Hereinafter, the substrate holder according to one embodiment of the present invention is described. However, the present invention is not limited to the embodiment.

A substrate holder 1 according to one embodiment of the present invention is used for holding a substrate W for plating on a surface of the substrate W in a substrate plating device and the like, as shown in FIG. 1 or FIG. 2. The substrate holder 1 according to the first embodiment is used for holding a round wafer as the substrate W.

As the substrate plating device, a conventional device may be used. For example, the following substrate plating device 100 may be used.

In a rough explanation, as shown in FIG. 3, the substrate plating device 100 is provided with a hoop 101, an aligner 102, a spin-rinse dryer 103, a fixing unit 104 on which the substrate holder 1 is to be placed, and a substrate conveyor device 105 provided in a center of these members, the substrate conveyor device 105 enabling delivery of the substrate W to the substrate holder 1.

The substrate plating device 100 is further provided with a stocker 106, a prewetting tank 107, a presoaking tank 108, a first washing tank 109, a blow tank 110, a second washing tank 111, and a plating tank 112, and enables washing, etching and the like of the substrate W through conveyance of the substrate holder 1 from the prewetting tank 107 to the second washing tank 111, sequentially. Conveyance of the substrate holder 1 may be carried out by a substrate holder conveyor device 114.

The plating tank 112 is provided with a plurality of plating cells 113, each of which is configured to accommodate one substrate W and immerse the substrate W in the plating solution contained thereinside to apply a plate such as a copper plate on the surface of the substrate W.

In addition, the substrate holder conveyor device 114 is provided with a first transporter 115 and a second transporter 116, enabling the substrate holder 1 to be conveyed in a state of being oriented in a vertical direction.

An example of a plating process by the substrate plating device 100 is described.

First, one substrate is taken out from the hoop 101 storing the substrate W by means of the substrate conveyor device 105, and conveyed to the aligner 102. The aligner 102 aligns positions of an orientation flat, a notch, and the like in predetermined directions. The substrate W thus aligned in orientation by the aligner 102 is conveyed to the fixing unit 104 by the substrate conveyor device 105.

The substrate holder 1 accommodated in the stocker 106 is conveyed to the fixing unit 104 and then the substrate W is conveyed to the substrate holder 1 by the substrate conveyor device 105 to cause the substrate holder 1 to hold the substrate W.

Next, the substrate holder 1 holding the substrate W is conveyed sequentially to the prewetting tank 107, the pre-soaking tank 108, the first washing tank 109, and the plating tank 112 by the first transporter 115 and the second transporter 116, and stored in the plating cell 113 filled with the plating solution. The substrate holder 1 holding the substrate W is thus stored in each plating cell 113 in the plating tank 112.

In each plating cell 113, plating voltage is applied between an anode and the substrate W in the plating cell 113, to carry out plating on the surface of the substrate W.

After completion of plating, the substrate holder 1 holding the substrate thus plated is conveyed sequentially to the second washing tank 111 and the blow tank 110, and then the substrate holder 1 is conveyed to the fixing unit 104.

In the fixing unit 104, the substrate W thus processed is removed from the substrate holder 1 by the substrate conveyor device 105, and conveyed to and dried in the spin-rinse dryer 103. The substrate W thus dried is returned to the hoop 101 by the substrate conveyor device 105.

A plate can thus be applied to the substrate W held by the substrate holder 1.

As for a more detailed configuration of the substrate plating device 100, description in paragraphs [0011] to [0017] and the like of the Specification of Japanese Patent Application No. 2018-119875 filed by the present applicants may be referenced.

The substrate holder 1 is provided with the first holding member 2 and the second holding member 3 as shown in FIG. 1 or FIG. 2. Note that FIG. 1 or FIG. 2 shows the substrate holder 1 oriented in the vertical direction.

The substrate holder 1 is configured such that the substrate W is sandwiched between the first holding member 2 and the second holding member 3, which are fixedly joined to hold the substrate W, and may be provided in the substrate plating device 100 illustrated in FIG. 3 and the like.

The substrate W may be exemplified by a semiconductor substrate (wafer), a glass substrate, a printed circuit board and the like, and also includes a magnetic recording medium, a magnetic recording sensor, a mirror, an optical element, a micro-mechanical element, a partially-fabricated integrated circuit, and the like.

The first holding member 2 is also referred to as a fixed holding member, and is provided with: a body portion 21 that forms an outer face; a substrate mount table 22 that supports the substrate W placed thereon; a hanging ring 23 for fixing the second holding member 3; a hand portion 24 for suspending the substrate holder 1 upon immersion in the plating solution and the like; and an external contact 25 electrically connected to an external power source, as shown in FIG. 1, FIG. 2, or FIG. 4.

The body portion 21 is formed of a resin such as PTFE (polytetrafluoroethylene) and the like, and configured as a plate-like housing as shown in FIG. 1 or FIG. 2 in which the substrate mount table 22, the hanging ring 23, a base plate 26 and the like are arranged.

The base plate 26 is formed of an electrically conductive metal such as stainless steel, configured in a round planar shape with a plurality of fan-shaped openings, and arranged on one end side (a lower end side in FIG. 1) of the body portion 21.

The substrate mount table 22 is configured in a round planar shape as shown in FIG. 2 or FIG. 4, and is attached on the base plate 26 via a compression spring 22*a* and the like as shown in FIG. 4, being biased toward the substrate W (upper side in FIG. 4).

The hanging ring 23 is formed of an electrically conductive metal such as stainless steel, configured in a ring shape formed of a flat plate, and arranged inside a circumferential groove portion 21*a* provided along an outer edge of the substrate mount table 22 of the body portion 21 as shown in FIG. 4, so as to be rotationally movable inside the circumferential groove portion 21*a*. In addition, the hanging ring 23 is configured to be sandwiched between the body portion 21 and the base plate 26, in contact with the base plate 26.

The hanging ring 23 is provided with a plurality of through holes 23*a* as shown in FIG. 5, so that fixation of the second holding member 3 is enabled through engagement thereof with a hanging pin 35, described later, of the second holding member 3. The through hole 23*a* is in a keyhole-like shape, in which a larger diameter hole section 23*b*, which is larger in diameter, and a smaller diameter hole section 23*c*, which is smaller in diameter, overlap.

Note that, in the present embodiment, the hanging ring 23 is configured to be rotationally movable by moving a rod member 4 shown in FIG. 2 in an up-down direction. For example, moving the rod member 4 downward engages the hanging pin 35 with the smaller diameter hole section 23*c* as shown in FIG. 11, and moving the rod member 4 upward disengages the hanging pin 35 from the smaller diameter hole section 23*c*.

The hand portion 24 is provided on one end side (an upper end side in FIG. 1) of the body portion 21 as shown in FIG. 1 or FIG. 2, and formed to protrude to both left and right sides from the body portion 21, whereby the substrate holder 1 can be suspended upon immersion in the plating solution and the like. The external contact 25 is provided on one face (lower face when the substrate holder 1 is suspended) of the protruding portion of the hand portion 24 on one side.

The external contact 25 is connected to a conductive wire 25*a* linked to the base plate 26 as shown in FIG. 2, so as to be electrically connected to the external power source to permit an electric current to be applied to the base plate 26 when the substrate holder 1 is immersed in the plating solution.

The second holding member 3 is also referred to as a movable holding member, and is configured in a round ring shape with an opening portion 3*a* as shown in FIG. 1 or FIG. 4, so as to be put on a circumference of the substrate mount table 22 holding the substrate W to secure the substrate W, whereby the substrate W can be held with the surface being exposed to the opening portion 3a.

The second holding member 3 is provided with: a main body portion 31; an electrical contact 32 to be in contact with the edge portion of the substrate W; an upper seal portion 33 and a lower seal portion 34 that hermetically seal a space formed by the first holding member 2 and the second holding member 3 when the substrate is held; and the hanging pin 35, as shown in FIG. 4.

The main body portion 31 is in a round ring shape with a laterally long rectangular cross-sectional shape as shown in FIG. 6, on which the electrical contact 32, described later, can be provided along an inner peripheral face 31*a*. In addition, a protruding strip portion 31*e* protruding to an inner side of the ring in an eave-like shape is provided on an upper face of the main body portion 31 over an entire circumference, so as to cover a gap space formed between the first holding member 2 and the second holding member 3 and surround the electrical contact 32, when the substrate W is held.

The main body portion 31 is formed of an electrically conductive metal such as stainless steel, aluminum, and the like, and is configured such that, when the substrate W is held, the hanging pin 35 provided on a lower face of the main body portion 31 comes into contact with the hanging ring 23 to be electrically connected to the base plate 26, the hanging ring 23, and the main body portion 31 as shown in FIG. 12, to thereby permit an electric current to be applied to the electrical contact 32.

The inner peripheral face 31*a* of the main body portion 31 is formed to be substantially perpendicular to the upper face of the second holding member 3, such that the surface is a smooth surface and the electrical contact 32 can be arranged along this face. The inner peripheral face 31*a* is in a round shape in a planar view. By thus configuring the inner peripheral face 31*a* in a curved face shape curved in an inner-outer direction of the second holding member 3, an elastic force acts when the electrical contact 32 is arranged, whereby positional shift of the electrical contact 32 can be prevented.

In addition, a plurality of engaging shaft portions 36 are provided on the inner peripheral face 31*a* at substantially regular intervals, as shown in FIG. 6 and FIG. 7. The engaging shaft portion 36 is configured in a shape having a head portion 36*b* in an expanded head shape at the tip end portion of a shaft portion 36*a*.

In the present embodiment, the engaging shaft portion 36 is configured to have the shaft portion 36*a* in a round shaft shape and the head portion 36*b* in a round planar shape greater in diameter than the shaft portion 36*a*. More specifically, the engaging shaft portion 36 is formed of a flat head screw and fastened to a first fastening hole 31*b* 6 provided on the inner peripheral face 31*a*.

Between the inner peripheral face 31*a* and the head portion 36*b*, a gap into which the electrical contact 32 can be inserted is provided as shown in FIG. 7 (C).

On the inner peripheral face 31*a*, a second fastening hole 31*c* is provided between the engaging shaft portions 36 as shown in FIG. 6 or FIG. 7, to permit a fastening member S such as a screw to be fastened to fix the electrical contact 32 as shown in FIG. 8. Note that the first fastening hole 31*b* 6 and the second fastening hole 31*c* may have either the same diameter or different diameters. In addition, the second fastening hole 31*c* may be omitted.

The plurality of hanging pins 35 protruding downward in a shaft-like shape are provided on the lower face of the main body portion 31 as shown in FIG. 4 to be engageable with the through holes 23*a* of the first holding member 2. In addition, a plurality of engagement grooves 31*d* with a predetermined depth that open in an elongated hole shape are provided, to permit a hook piece portion 32*c* of the electrical contact 32, described later, to engage therewith.

The electrical contact 32 is to come into contact with the substrate W to apply an electric current. In the following description of the electrical contact 32, the side shown in FIG. 7(A) is supposed to be a front face side.

The electrical contact 32 is in a rectangular plate-like shape, more specifically in a laterally long rectangular plate-like shape. The thickness of the electrical contact 32 is not particularly limited, and such a thickness that the electrical contact 32 can be deflected to facilitate attachment or detachment with respect to the inner peripheral face 31*a* is preferred.

In the electrical contact 32: a contact portion 32*a*, in a comb teeth shape with a plurality of slits, to be in contact with the edge portion of the substrate W is provided on one longitudinal end portion side (upper side in FIG. 9(C)); an engagement reception portion 32*b* in a notch shape is provided on both shorter-side end portion sides (left and right sides in FIG. 9(C)); and a hook piece portion 32*c* in a hook shape is provided on the other longitudinal end portion side (lower side in FIG. 9(C)).

The contact portion 32*a* is a part to be in contact with the edge portion of the substrate W in a state in which the first holding member 2 and the second holding member 3 hold the substrate W, to permit an electric current to be applied to the substrate W as shown in FIG. 8, and is formed by bending an upper side of the electrical contact 32 in a curved manner such that a fore end portion is in a horizontal plane shape. The contact portion 32*a* is configured in the comb teeth shape by providing a plurality of slits from the fore end portion side, to be in elastic contact with the edge portion of the substrate W. In the present embodiment, 22 slits are provided at regular intervals; however, the present invention is not limited thereto and, for example, the electrical contact 32X with 45 slits as shown in FIG. 10(A) to (D) may also be employed.

The engagement reception portion 32*b* is provided in the vicinity of the center in the height direction of the left and right side end portions of the electrical contact 32 as shown in FIG. 9(A) to (C), and formed in a notch shape to permit engagement with the shaft portion 36*a* of the engaging shaft portions 36.

The shape of the engagement reception portion 32*b* is only required to be a notch shape and not particularly limited; however, a shape narrowing in the depth direction such as a horizontal V-shape is preferred, and particularly a curved concave shape such as a horizontal U-shape or a semicircular shape is preferred in light of engageability with the engaging shaft portion 36.

Note that a distance between adjacent engaging shaft portions 36 is preferably slightly greater than the shortest distance between the engagement reception portions 32*b* of the electrical contact 32, to facilitate attachment of the electrical contact 32 to the engaging shaft portions 36. In addition, the width of the engagement reception portions 32*b* is preferably substantially the same as the width of the engaging shaft portion 36, to inhibit up-down movement of the electrical contact 32 upon attachment.

The hook piece portion 32*c* extends from the lower end portion of the electrical contact 32 to a back face side and is in a hook shape with a fore end portion being bent upward as shown in FIG. 9(B) or (D), to permit the fore end portion to engage with the engagement groove 31*d*. In the present embodiment, the hook piece portion 32*c* is provided in two sites; however, the present invention is not limited thereto.

The electrical contact 32 is provided with a hole portion 32*d* in the vicinity of the center as shown in FIG. 9(C), through which the fastening member S such as a screw can be inserted and fastened to the second fastening hole 31*c* as shown in FIG. 8. In the present embodiment, the hole portion 32*d* is round; however, the present invention is not limited thereto. In addition, the hole portion 32*d* is not necessarily required.

Furthermore, the electrical contact 32 is provided with a positioning piece 32*e* extending in the vicinity of the middle of the lower end portion to the back face side as shown in FIG. 9(B), that comes into contact with the lower face of the main body portion 31 to permit positioning in the up-down direction when being fixed to the main body portion 31 of the second holding member 3.

Detailed description of a method of attaching the electrical contact 32 to the main body portion 31 is provided later.

The upper seal portion 33 and the lower seal portion 34 are configured in a ring shape formed from an elastic material such as rubber, silicon and the like, hermetically seal the space formed by the first holding member 2 and the second holding member 3 as shown in FIG. 8, whereby the plating solution is prevented from infiltrating and adhering to the electrical contact 32 and the like during plating.

The upper seal portion 33 is arranged on the inner peripheral side of the main body portion 31, and, in a state in which the substrate W is held, a fore end portion thereof can come into contact with the surface of the substrate W placed on the substrate mount table 22 of the first holding member 2 as shown in FIG. 8, to prevent the plating solution from infiltrating.

The lower seal portion 34 is arranged on the outer peripheral side of the main body portion 31, and, in a state in which the substrate W is held, a fore end portion thereof can come into contact with the upper face of the body portion 21 of the first holding member 2 as shown in FIG. 8, to prevent the plating solution from infiltrating.

The upper seal portion 33 and the lower seal portion 34 is fixed in a sandwiched manner between the main body portion 31 and a seal ring holder 37 as shown in FIG. 4 or FIG. 8.

The hanging pin 35 is formed of an electrically conductive metal such as stainless steel, configured in a circular cylindrical shaft shape protruding downward from the lower face of the main body portion 31 as shown in FIG. 4, and has a locking larger diameter portion 35*a* overhanging outward from the middle of the shaft. In the present embodiment, the hanging pin 35 has a threaded portion in the tip end portion and is fastened to a screw hole (not illustrated) provided on the lower face of the main body portion 31.

The locking larger diameter portion 35*a* is smaller in diameter than the larger diameter hole section 23*b* of the through hole 23*a* of the hanging ring 23, and larger in diameter than the smaller diameter hole section 23*c*, whereby the second holding member 3 can be fixed to the first holding member 2 in such a way that the hanging ring 23 is moved in a state in which the locking larger diameter portion 35*a* is inserted through the larger diameter hole section 23*b* as shown in FIG. 5, and then the smaller diameter hole section 23*c* locks the hanging pin 35 as shown in FIG. 11.

As for a more detailed configuration of the substrate holder 1, description in paragraphs [0018] to [0114] and the like of the Specification of Japanese Patent Application No. 2018-119875 filed by the present applicants may be referenced.

The electrical contact 32 may be attached to the second holding member 3 as follows, for example.

First, one of left and right end edge portions of the electrical contact 32 is slid into a gap between the head portion 36*b* of the engaging shaft portion 36 and the inner peripheral face 31*a*, while the shaft portion 36*a* is inserted and then advanced deep into the engagement reception portions 32*b*.

Next, the electrical contact 32 is deflected to be slightly curved, and the other of the left and right end edge portions of the electrical contact 32 is slid into a gap between the head portion 36*b* of the adjacent engaging shaft portion 36 and the inner peripheral face 31*a*, while the shaft portion 36*a* is inserted into the engagement reception portions 32*b*, and both engagement reception portions 32*b* are engaged with the engaging shaft portions 36.

An area in the vicinity of the center of the electrical contact 32 is pressed along the inner peripheral face 31*a* of the second holding member 3, and then the hook piece portions 32*c* are engaged with the engagement grooves 31*d* as shown in FIG. 7 (C).

And then, the fastening member S such as a screw is inserted into the hole portion 32*d* and fastened to the second fastening hole 31*c*, whereby the electrical contact 32 can be fixed to the second holding member 3 as shown in FIG. 8. By sequentially arranging other electrical contacts 32 in a similar manner on the inner peripheral face 31*a* of the second holding member 3, the electrical contact 32 can be attached. In a state of being attached to the inner peripheral face 31*a*, due to the action of the elastic force with which the electrical contact 32 springs back from the deflected state, the electrical contact 32 can be stably attached along the inner peripheral face 31*a*. As a result, the position where the contact portion 32*a* of the electrical contact 32 is in contact with the substrate W can be prevented from shifting in the radial direction of the substrate W.

In order to cause the substrate holder 1 to hold the substrate W, the substrate W is placed on the substrate mount table 22 of the first holding member 2 and then the second holding member 3 is overlaid on the circumference thereof. At this moment, as shown in FIG. 4 or FIG. 5, the hanging pin 35 is positioned above the larger diameter hole section 23*b* of the through hole 23*a*. And then, while lightly pressing the second holding member 3, the locking larger diameter portion 35*a* is inserted into the larger diameter hole section 23*b*, and positioned below the hanging ring 23. In this state, pressing (moving downward) the rod member 4 rotates the hanging ring 23 to move the relative position of the hanging pin 35 from the larger diameter hole section 23*b* to the smaller diameter hole section 23*c*, whereby the locking larger diameter portion 35*a* is engaged with the hanging ring 23, and the second holding member 3 is fixed to the first holding member 2 as shown in FIG. 11 or FIG. 12. The upper seal portion 33 is capable of elastically pressing the edge portion of the substrate W to cause the substrate holder 1 to hold the substrate W. A surface exposed at this moment is the surface to be plated.

By immersing the substrate holder 1 in this state in the plating tank 112 of the substrate plating device 100 shown in FIG. 3 and applying an electric current to the substrate W, plating on the surface to be placed can be carried out. In this operation, the external contact 25 is connected to the external power source, and the electric current is applied to the external contact 25, the conductive wire 25*a*, the base plate 26, the hanging ring 23, the hanging pin 35, the main body portion 31, and the electrical contact 32 in this order, whereby the electric current can be applied to the substrate W.

The electrical contact 32 can be removed for replacement by carrying out the steps for attachment in reverse order. For example, the fastening member S, which has been fastened to the hole portion 32d, is loosened and removed, and the electrical contact 32 is pulled in a direction away from the inner peripheral face 31*a* to remove the hook piece portion 32*c* from the engagement groove 31*d*.

Next, while lightly deflecting the electrical contact 32, one of the left and right end edge portions is pulled to disengage the engagement reception portion 32*b* from the engaging shaft portion 36. And then, the engagement reception portion 32*d* on the other side is pulled and disengaged from the engaging shaft portion 36, whereby the electrical contact 32 can be removed.

As described above, the present invention enables attachment of the electrical contact 32 to the second holding member 3 through engagement of the engagement reception portion 32*b* in a notch shape with the engaging shaft portion 36, and enables removal of the electrical contact 32 through disengagement of these members, thus facilitating replacement of the electrical contact 32 and making the replacement operation more efficient.

In addition, the structure of the hook piece portion 32*c* engageable with the engagement groove 31*d* permits both the engagement reception portion 32*b* and the hook piece portion 32*c* to engage with, and to be less likely to be disengaged from, the second holding member 3. Especially in the case of the second holding member 3 configured in a ring shape, it is easier to follow the arc-like concave portion of the inner peripheral face 31*a*.

Furthermore, due to the hole portion 32*d* provided in the vicinity of the center of the electrical contact 32 permitting fastening to the second holding member 3 with the fastening member S such as a screw, reliable fixation is enabled with at least one fastening member, resulting in a smaller number of fixation members than the conventional art while providing the fixation force similar to that of the conventional art.

In the above-described embodiment, the main body portion 31 of the second holding member 3 is formed of an electrically conductive material; however, the present invention is not limited thereto and the main body portion 31 may also be formed of an electrically nonconductive material such as a vinyl chloride resin. In this case, it is preferred that a lower end edge portion of the electrical contact 32 is configured to come into contact with the base plate 26 via an arbitrary elastic member to enable application of an electric current.

In addition, in the above-described embodiment, the substrate holder 1 is configured to be able to hold the round substrate W; however, the present invention is not limited thereto and the substrate holder 1 may also be configured to be able to hold a polygonal substrate such as a rectangular substrate.

For example, FIG. 13 shows a substrate holder 10 of the second embodiment which is provided with a front plate (second holding member) 11 in a rectangular planar frame-like shape with a rectangular opening portion 12 and a planar back plate (first holding member) 13, thus permitting plating on the substrate W exposed from the opening portion 12 in a state in which the substrate W is held in a sandwiched manner between the front plate 11 and the back plate 13.

The front plate 11 is provided with an electrical contact 14 on the inner peripheral side as shown in FIG. 14, attached on a face of the front plate 11 parallel to the surface of the substrate W, and it is configured that, when the substrate W is held, a tip end portion of the electrical contact 14 comes into contact with the edge portion of the substrate W to enable application of an electric current.

Also with the substrate holder 10 of such a mode, the above-described attachment structure with the shaft-like engaging shaft portion 36 and the notch-like engagement reception portion 32*b* may be employed as an attachment structure for the electrical contact 14.

As for details of the substrate holder 10, for example, description in paragraphs [0034] to [0073] of Japanese Patent Laid-Open No. 2018-40045 may be referenced.

Alternatively, it may also be configured to permit plating on both faces of a substrate.

For example, FIG. 15 shows a substrate holder 15 of the third embodiment which is provided with a first holding member 16 and a second holding member 17 in rectangular planar frame-like shapes, having respective rectangular opening portions 18*a*, 18*b*. The first holding member 16 and the second holding member 17 hold the substrate W in a sandwiched manner and permit plating on the substrate W exposed from the opening portions 18*a*, 18*b*.

The first holding member 16 and the second holding member 17 are provided with respective electrical contacts 19*a*, 19*b* on the inner peripheral sides as shown in FIG. 16, and it is configured that, when the substrate W is held, respective tip end portions of the electrical contacts 19*a*, 19*b* come into contact with the edge portion of the substrate W to enable application of an electric current.

Also with the substrate holder 15 of such a mode, the above-described attachment structure with the shaft-like engaging shaft portion 36 and the notch-like engagement reception portion 32*b* may be employed as an attachment structure for the electrical contacts 19*a*, 19*b*.

As for details of the substrate holder 15, for example, description in paragraphs [0025] to [0158] of Japanese Patent Laid-Open No. 2019-7075 may be referenced.

In the substrate holder shown in FIG. 15, the substrate mount table may be omitted. In addition, depending on the embodiment, upon sandwiching the substrate in the substrate holder, the substrate may also be placed on the side of the second holding member to which the electrical contact is attached.

REFERENCE SIGNS LIST

1 Substrate holder
2 First holding member
  21 Body portion
    21*a* Circumferential groove portion
  22 Substrate mount table
  23 Hanging ring
    23*a* Through hole
    23*b* Larger diameter hole section
    23*c* Smaller diameter hole section
  24 Hand portion
  25 External contact
    25*a* Conductive wire
  26 Base plate
3 Second holding member
  3*a* Opening portion
  31 Main body portion
    31*a* Inner peripheral face
    31*b* 6 First fastening hole
    31*c* Second fastening hole
    31*d* Engagement groove
    31*e* Protruding strip portion

32, 32X Electrical contact
32*a* Contact portion
32*b* Engagement reception portion
32*c* Hook piece portion
32*d* Hole portion
32*e* Positioning piece
33 Upper seal portion
34 Lower seal portion
35 Hanging pin
35*a* Locking larger diameter portion
36 Engaging shaft portion
36*a* Shaft portion
36*b* Head portion
37 Seal ring holder
4 Rod member
100 Substrate plating device
W Substrate
S Fastening member

The invention claimed is:

1. A substrate holder for plating on a surface of a substrate, comprising:
a first holding member;
a second holding member that has an opening portion for exposing the surface of the substrate and holds the substrate in a sandwiched manner with the first holding member;
a plurality of engaging shaft portions each having a head portion in an expanded head shape at a tip end portion, provided in a circumferential direction of the second holding member; and
an electrical contact having a contact portion to be in contact with an edge portion of the substrate, and having an engagement reception portion in a notch shape to be engaged with an adjacent engaging shaft portion for arrangement along a circumference of the opening portion of the second holding member.

2. The substrate holder according to claim 1, wherein the engagement reception portion is configured as a notch in a curved concave shape.

3. The substrate holder according to claim 1, wherein the electrical contact is provided with a hook piece portion in a hook shape to be engaged with an engagement groove provided in the second holding member.

4. The substrate holder according to claim 1, wherein:
a hole portion is provided in the vicinity of the center of the electrical contact; and
the electrical contact is fixed to the second holding member by inserting a fastening member into the hole portion and fastening the fastening member.

5. The substrate holder according to claim 1, wherein the second holding member is formed of an electrically conductive metal.

6. The substrate holder according to claim 1, wherein:
the second holding member comprises, on a side of the opening portion, an inner peripheral face curved in an inner-outer direction of the second holding member; and the electrical contact is attached along the inner peripheral face.

7. The substrate holder according to claim 1, wherein the second holding member is configured in a polygonal frame shape.

8. The substrate holder according to claim 1, wherein the second holding member is configured in a round frame shape.

9. A substrate plating device comprising the substrate holder according to claim 1.

10. An electrical contact attachment structure for attaching an electrical contact for applying an electric current to a substrate held by a substrate holder, wherein:
the substrate holder comprises a first holding member, and a second holding member that has an opening portion for exposing the surface of the substrate and holds the substrate in a sandwiched manner with the first holding member;
the second holding member comprises engaging shaft portions each having a head portion in an expanded head shape at a tip end portion, provided in a circumferential direction;
the electrical contact comprises an engagement reception portion in a notch shape provided on sides of opposite end edge portions, and a contact portion to be in contact with an edge portion of the substrate;
the engagement reception portion is engaged with an adjacent engaging shaft portion; and
the electrical contact is arranged along a circumference of the opening portion of the second holding member.

* * * * *